United States Patent [19]

van Mensvoort et al.

[11] Patent Number: 4,739,294

[45] Date of Patent: Apr. 19, 1988

[54] DEVICE COMPRISING A CORE CONSISTING OF PARTS OF AMORPHOUS FERROMAGNETIC METAL AND PARTS OF NON-AMORPHOUS FERROMAGNETIC MATERIAL

[75] Inventors: Adrianus J. van Mensvoort, Eindhoven; Antonius M. F. Geerts, Tilburg, both of Netherlands

[73] Assignee: U.S. Philips Corporation, New York, N.Y.

[21] Appl. No.: 26,240

[22] Filed: Mar. 16, 1987

[30] Foreign Application Priority Data

Mar. 26, 1986 [NL] Netherlands ..... 8600771

[51] Int. Cl.[4] ..... H01F 3/10

[52] U.S. Cl. ..... 335/297; 336/212

[58] Field of Search ..... 335/296, 297; 336/211, 336/212, 233; 148/403

[56] References Cited

U.S. PATENT DOCUMENTS 4,529,457 7/1985 Kushnick et al. ..... 148/403

4,587,507 5/1986 Takayama et al. ..... 148/403

*Primary Examiner*—George Harris

*Attorney, Agent, or Firm*—Robert T. Mayer; Bernard Franzblau

[57] ABSTRACT

A device having a core that comprises a bar-shaped leg (1) of amorphous ferromagnetic metal which is surrounded by a coil (7), and a yoke (3) which magnetically interconects the end portions of the leg and which is made of ferrite. The cross-sectional area of the yoke (3) is at least twice as large as that of the leg (1). This construction combines the advantages of the low core losses of amorphous metal and a low cost price.

2 Claims, 1 Drawing Sheet

DEVICE COMPRISING A CORE CONSISTING OF PARTS OF AMORPHOUS FERROMAGNETIC METAL AND PARTS OF NON-AMORPHOUS FERROMAGNETIC MATERIAL

BACKGROUND OF THE INVENTION

The invention relates to a device comprising a core which is composed of parts of amorphous ferromagnetic metal and parts of non-amorphous ferromagnetic material and which comprises at least one bar-shaped leg which is surrounded by at least one coil wound from electrically conductive material, and also comprises a yoke which magnetically interconnects the end portions of the leg and whose cross-sectional area is larger than that of the leg.

A device of this kind is known from the abstract of JP-A-57-143-807 published in "Patent Abstracts of Japan", Vol. 6, No. 243 (E-145). The legs of the core of the known device are made of silicon iron and the yokes are made of amorphous metal. However, due to the core losses in the silicon iron, such cores are less suitable for use with comparatively high frequencies, for example 10 kHz and higher. Notably in the case of cores having comparatively large dimensions, the temperature of the core portion within the coil will become too high. The core losses of amorphous metal are substantially lower than those of silicon iron (approximately 70% lower). Therefore, it would be attractive to make the entire core of amorphous metal so that the temperature of the portions situated within the coil would not rise to such high values. However, such a core, which is known, for example from EP-A No. 0 127 119, has the drawback that the price of amorphous metal is high, so that the cost price of the core will also be higher.

SUMMARY OF THE INVENTION

It is an object of the invention to provide a device of the kind set forth which combines low core losses and an acceptable cost price. To achieve this, the device in accordance with the invention is characterized in that the leg is made of amorphous ferromagnetic metal and the yoke is made of ferrite, the cross-sectional area of the yoke being at least twice as large as that of the leg.

In the device in accordance with the invention, the yokes, which contain a substantial part of the core material, are made of ferrite which is a comparatively cheap material and which has comparatively low core losses, like the amorphous metal. A drawback of ferrite consists in its low saturation magnetization. However, this drawback does not have adverse effects in the device in accordance with the invention because the cross-sectional area of the yoke is at least twice as large as that of the leg. Due to the high saturation magnetization of the amorphous metal, the leg may have a comparatively small cross-sectional area. Consequently, the dimensions of the coil arranged around the leg may also be small and hence the amount of material required for the coil will be comparatively small. As a result of this the cost price of the device will be further reduced.

In order to preclude local magnetic saturation of the ferrite near the transitions between the leg and the yoke, a preferred embodiment of the device in accordance with the invention is characterized in that each end portion of the leg is located partly in a recess formed in the yoke.

BRIEF DESCRIPTION OF THE DRAWING

The invention will be described in detail hereinafter with reference to the drawing; therein.

DESCRIPTION OF THE PREFERRED EMBODIMENTS

Figure 1A:
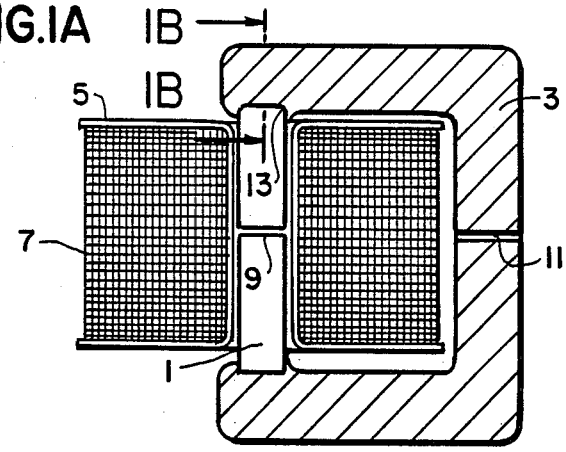
FIG. 1A is a longitudinal sectional view of a first embodiment of a device in accordance with the invention.

The device shown in FIG. 1A comprises a ferromagnetic core having a bar-shaped leg 1 and a U-shaped yoke 3 which magnetically interconnects the end portions of the leg in order to form a closed magnetic circuit. The leg 1 is surrounded by a coil former 5 which is made of an electrically insulating material and on which one or more coils 7 are wound. The details of the coils 7 depend on the intended use of the device. For example, when the device forms a choke coil, generally only one coil 7 will be present, whereas in the case of a transformer there will be provided two or more coils which can be wound concentrically one over the other or which can be arranged one behind the other in the axial direction. The coils are wound from electrically conductive material, for example copper wire or aluminium foil.

Figure 1B:
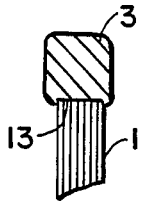
FIG. 1B is a cross-sectional view of a detail of the device shown in FIG. 1A.

The leg 1 consists of a stack of laminations of amorphous ferromagnetic metal which extend parallel to the plane of drawing (see also FIG. 1B), an air gap 9 being provided approximately halfway along the length of the leg in the present embodiment. The yoke 3 is made of a ferrite, for example ferroxcube. It is composed of two L-shaped portions which are interconnected at the area 11, for example by means of an adhesive. At the area of the joint 11 there may also be provided an air gap, if desired. The cross-section of the leg 1 is shaped as a first square and the cross-section of the yoke 3 is shaped as a second square whose sides are, for example approximately 1.5 times as long as those of the first square. The cross-sectional area of the yoke 3 thus is more than twice as large as that of the leg 1. It has been found that using such a ratio of the cross-sectional areas, the leg 1 and the yoke 3 become saturated approximately simultaneously when the magnetic flux in the core increases. The flux density in the leg 1 is then about twice as high as that in the yoke 3. Therefore, near the transition between the leg and the yoke the flux density in the ferrite is liable to become locally higher than the saturation density. This risk can be substantially reduced by ensuring that the magnetic lines of force diverge directly behind the transition between the leg 1 and the yoke 3, so that the magnetic flux density decreases very rapidly beyond this transition. To this end, the yoke 3 of the present embodiment is provided with a recess 13 at the area of each transition, an end face and an end portion of the leg 1 being accommodated in each recess (see also FIG. 1B). The material of the yoke 3 thus encloses the end portion of the leg 1 so that directly behind the transition the flux density in the yoke is substantially lower than that in the leg.

Figure 2A:
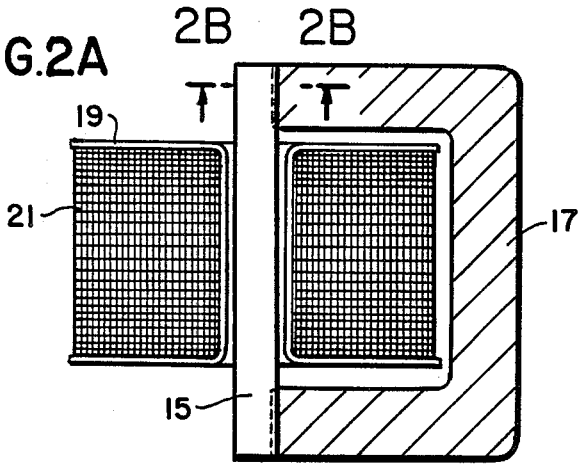
FIG. 2A is a longitudinal sectional view of a second embodiment.
Figure 2B:
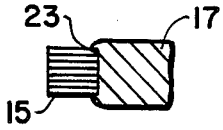
FIG. 2B is a cross-sectional view of a detail of the device shown in FIG. 2A.

The embodiment shown in FIG. 2A also comprises a ferromagnetic core which is composed of, on the one hand, a bar-shaped leg 15 which consists of a stack of laminations of amorphous metal and, on the other hand, U-shaped yoke 17 which consists of ferrite. The leg 15 is enclosed by a coil former 19 on which there are provided one or more coils 21. These elements may be identical to the coil former 5 with the coils 7 shown in FIG. 1A. The leg 15 of the embodiment shown in FIG. 2A is not provided with an air gap and the yoke 17 is also constructed as one integral unit. The ratio of the cross-sectional areas of the leg 15 and the yoke 17 is the same as in the first embodiment. In the second embodiment the end faces of the yoke 17 are provided with recesses 23 in which the end portions of the leg 15, including their side faces, are accommodated (see also FIG. 2B). Like the recesses 13 in the first embodiment, the recesses 23 ensure that the density of the magnetic flux in the material of the yoke 17 directly beyond the transitions is substantially lower than that in the material of the leg 15, so that local saturation will not occur. It will be apparent that, if desired, air gaps can also be provided in the leg 15 and/or the yoke 17 of the second embodiment.

Figure 3:
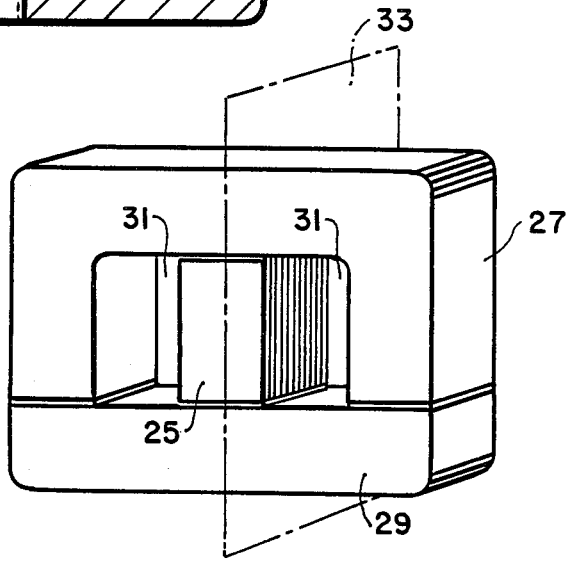
FIG. 3 is a perspective view of a core of a third embodiment.

FIG. 3 shows a core for a third embodiment which has been designed to replace a known ferrite core of the type E+I. The central leg of the E-shaped portion, which constitutes the leg of the core, has been replaced by a bar-shaped leg 25 which consists of a stack of laminations of amorphous ferromagnetic metal. The core also comprises a yoke which consists of a U-shaped portion 27 (corresponding to the original E-shaped portion without a central Leg) and an I-shaped portion 29. Between the leg 25 and the portions of the U-shaped portions 27 which extend parallel thereto, there are formed spaces 31 for a coil (not shown) to be arranged around the leg. The core is symmetrical with respect to a plane of symmetry 33 which is denoted by stroke/dot lines. The parts of the yoke 27, 29 which are situated on both sides of the plane of symmetry 33 have the same cross-sectional area as the leg 25, so that the overall cross-sectional area of the yoke is twice as large as that of the leg. Because the yoke 27, 29 extends to the left as well as to the right of the leg at the area of the transitions to the leg, the magnetic lines of force in the material of the yoke will diverge to the left and to the right, so that the risk of local saturation of the material will only be slight. Therefore, recesses in the yoke 27, 29, similar to the recessed 13, 23, can usually be dispensed with.

Comparison of the dimensions of the core shown in FIG. 3 with those of a comparable E+I core made entirely of ferrite immediately reveals the advantages of the construction in accordance with the invention. For the same cross-sectional area of the yoke, a leg made of ferrite should be twice as wide as the leg 25 in order to prevent the leg from being magnetically saturated sooner than the yoke. In order to accommodate a coil having the same number of turns, the spaces on both sides of the leg should have the same width as the spaces 31, so that the parts of the yoke which are shown horizontally in FIG. 3 should be proportionally longer. Consequently, for a conventional core the amount of core material and the amount of copper wire required for winding the coil will be larger than for the core in accordance with the invention. The mass of the core in accordance with the invention amounts to approximately 90% of that of the conventional core and the amount of copper wire required is approximately 70%. The saving as regards copper wire also reduces the electrical resistance of the coil and the resultant losses to approximately 70%.

In the embodiment described above, the core comprises only one leg which is enclosed by a coil. It will be apparent that the invention can also be advantageously used for cores which comprise more than one leg. The legs and yokes of the described embodiments have square or rectangular cross-sections. Evidently, the cross-sections may also have another shape, for example a circular or elliptical shape. Moreover, a leg may also consist of a tube whose wall is formed by a large number of turns of ribbon-like amorphous ferromagnetic material, for example as described in EP-A-0 127 119. The cross-section will be annular in that case.

What is claimed is:

1. A device comprising a core which is composed of parts of amorphous ferromagnetic metal and parts of non-amorphous ferromagnetic material and which comprises at least one bar-shaped leg surrounded by at least one coil wound from electrically conductive material, and a yoke which magnetically interconnects end portions of the leg and whose cross-sectional area is larger than that of the leg, characterized in that the leg is made of amorphous ferromagnetic metal and the yoke is made of ferrite, the cross-sectional area of the yoke being at least twice as large as that of the leg.

2. A device as claimed in claim 1, characterized in that each end portion of the leg is located partly in a recess formed in the yoke.

* * * * *